United States Patent [19]

Campana

[11] 4,060,459

[45] Nov. 29, 1977

[54] COKE OVEN DOOR FRAME AND JAMB

[76] Inventor: Patsie Carmen Campana, 2614 Sherwood Drive, Lorain, Ohio 44053

[21] Appl. No.: 703,111

[22] Filed: July 6, 1976

[51] Int. Cl.[2] ..... C10B 25/02

[52] U.S. Cl. ..... 202/248; 110/173 R

[58] Field of Search ..... 202/243, 248; 110/173 R (U.S. only)

[56] References Cited

U.S. PATENT DOCUMENTS

| | | | |
|---|---|---|---|
| 2,606,865 | 8/1952 | Forsans | 202/248 |
| 3,149,615 | 9/1964 | Forsans | 110/173 R X |
| 3,629,094 | 12/1971 | Silverblatt | 202/248 |
| 3,996,110 | 12/1976 | Campana | 202/248 |
| 4,002,537 | 1/1977 | Calderon | 202/248 |

*Primary Examiner*—Joseph Scovronek
*Assistant Examiner*—Roger F. Phillips
*Attorney, Agent, or Firm*—Fay & Sharpe

[57] ABSTRACT

An improved coke oven door frame and jamb assembly wherein the oven front wall which is defined by the frame has an elongated height dimension and the frame and jamb members which comprise the assembly are fabricated from steel plates. The jamb extends outwardly from the outer face of the frame adjacent the peripheral edges thereof outboard of an elongated coke oven door opening included in the frame. The jamb is comprised of a top jamb member, a bottom jamb member and opposed elongated side jamb members which are interconnected to each other at their ends. The frame includes elongated grooves in the outer face thereof adjacent the opposed side edges thereof with these grooves having a width $x$ adapted to receive the side jamb members which have a thickness $y$. Width $x$ is greater than thickness $y$ in order to provide a clearance area between the groove side walls and the associated side of the jamb members. The side jamb members are rigidly affixed to the frame by means of intermittent welds disposed longitudinally along the members on each side thereof. The welds on each side of each side member are centered with regard to the intermittent spaces between the welds on the other side.

9 Claims, 5 Drawing Figures

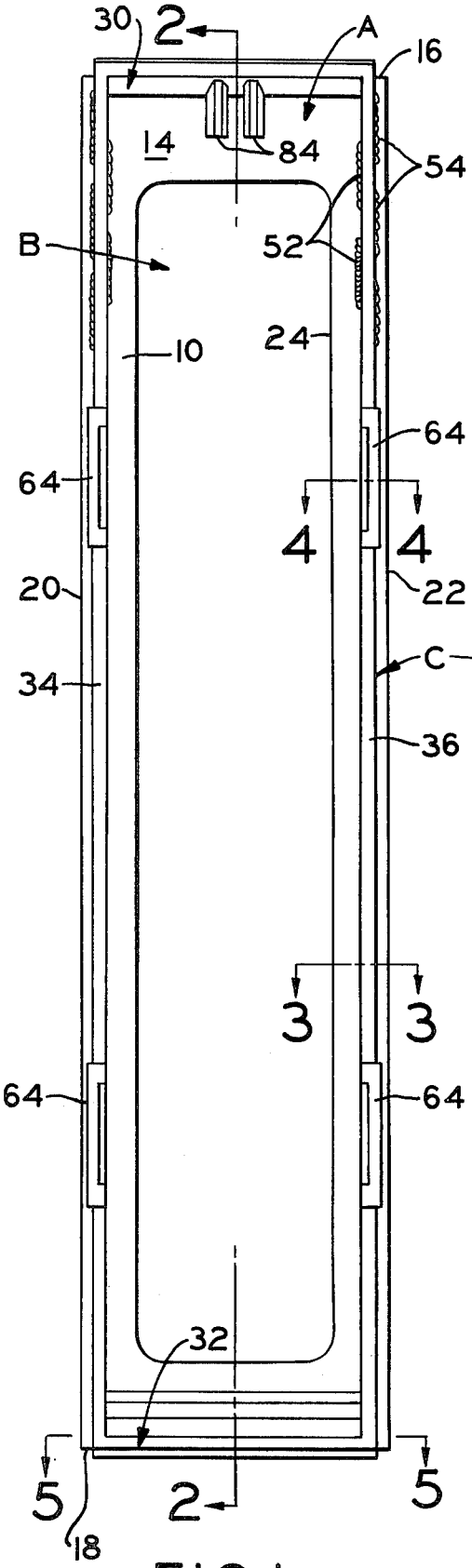
FIG. 1
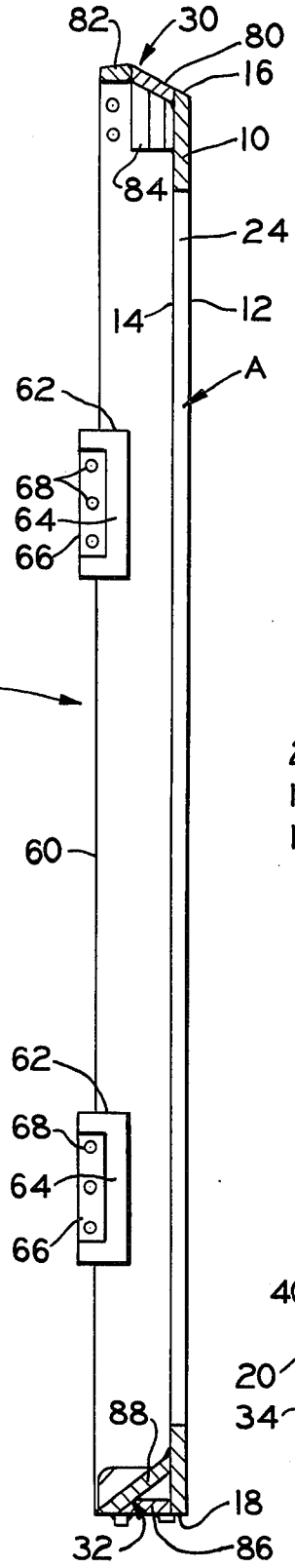
FIG. 2
FIG. 3
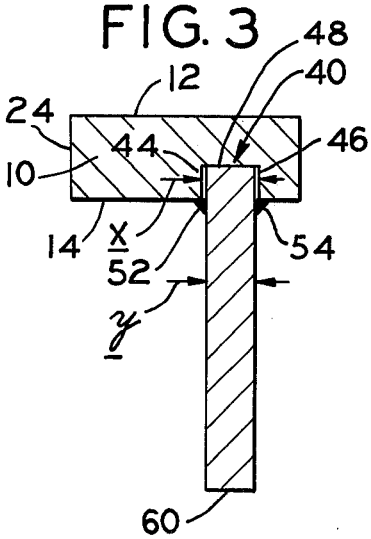
FIG. 4
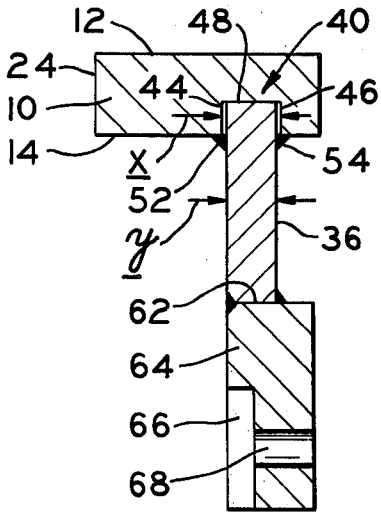
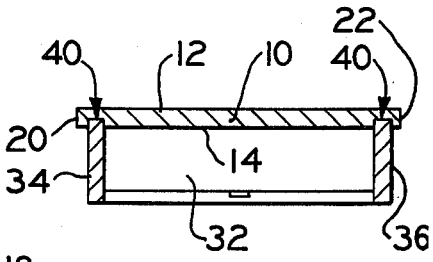
FIG. 5

COKE OVEN DOOR FRAME AND JAMB

BACKGROUND OF THE INVENTION

This invention relates to a door construction and more particularly to a door frame and jamb construction which is exposed to high temperatures.

The invention is particularly applicable to use as a coke oven door frame and jamb assembly and will be described with particular reference thereto; however, it will be appreciated by those skilled in the art that the invention has broader applications and may be used in other environments where a door frame and jamb assembly exposed to high temperatures must resist or be adapted to heat induced warpage which would otherwise prevent the assembly from performing the intended function in the intended manner.

Coke oven is a term employed for large ovens which are used to produce coke and coke by-proudcts from coal. While typically there are a number of types and styles of coke ovens, they typically have a substantially vertical height and depth in relation to the width and, in some respects, resemble a very large closet. In many instances, the height of these ovens is well over (10) feet and a substantial portion of the front face of the oven may be selectively opened and closed by means of a coke oven door. Normally, a plurality of the individual ovens are located in a side by side relationship to form what is commonly termed an oven battery in order that a high volume of coke and coke by-products may be made at one location.

In the type of oven described above, an oven door frame is provided which, in actuality, normally covers or defines substantially the entire front wall of the oven itself. This frame has an opening which is elongated in the vertical direction and which defines the coke oven access opening which may be selectively covered by the coke oven door itself. Interposed between the outer peripheral surface of this elongated opening and the outer peripheral edges of the frame to extend outwardly of the outer face thereof is a jamb. This jamb provides rigid support for the frame in an effort to reduce or eliminate warpage thereof during coking operations. Warpage is a significant problem due to the high temperatures, e.g., 2000° F and above, acting on the inside face of the frame and door during such operations.

In prior coke ovens, the frames and jambs have been constructed of cast iron and have typically been cast by foundries to be very thick or heavy in order to withstand the elevated operating temperatures and to provide rigidity therefor. However, such cast iron frames and jambs have an extremely undesirable characteristic in that they will lose their original shape when subjected to elevated temperatures, "hour glass" and then crack. Once distorted, it is extremely difficult to reshape these cast iron frames back to the original shape or condition while the frames remain in place on the associated ovens. Thus, proper repair of prior cast iron frames has necessitated that they be removed from the ovens for repair or reshaping and then reinstalled following such repair or reshaping. These maintenance requirements cause extremely undesirable and lengthy oven down time periods. If the frames are not maintained in a proper fitting relationship with the ovens and coke oven doors, there will be heat and pollution loss as well as air admission into the ovens. Such circumstances are undesirable from both environmental and overall operational points of view.

The subject invention is directed toward an improved construction for a coke oven frame and jamb assembly which overcomes the above discussed problems and provides an improved frame and jamb assembly which is simple to manufacture, readily adaptable to use on the various types and styles of conventional coke ovens, provides a structure which is extremely rigid and provides a structure which may be easily reshaped to its original configuration in place of a coke oven in the event there is distortion incurred during coking operations.

BRIEF DESCRIPTION OF THE PRESENT INVENTION

In accordance with the present invention, there is provided an improved frame and jamb assembly for coke ovens of the type having an elongated vertical opening in the front wall thereof with the frame received thereover and wherein the frame has a coke oven opening in the central portion thereof adapted to operably and selectively receive a coke oven door in a covering relationship therewith. The frame has generally flat inner and outer faces, a top edge, a bottom edge and opposed elongated side edges with a jamb disposed about the frame outer face adjacent the outer peripheral edges thereof so as to extend outwardly from the outer face. In the improved frame and jamb assembly, the frame outer face includes an elongated groove extending longitudinally therealong adjacent each side edge wherein the grooves each have a width $x$ and a groove bottom wall. An elongated side jamb member is received in each of the grooves to engage the groove bottom walls with the side jamb members each having a thickness $y$ which is less than width $x$. This dimensional configuration is such that a clearance area is provided between the portions of the side jamb members received in the grooves and the side walls of the grooves themselves with the remaining portions of the side jamb members extending outwardly of the frame outer face. The side jamb members are rigidly affixed to the outer face by means of welding. Top and bottom jamb members extend outwardly from the frame outer face between the side jamb members adjacent the frame top and bottom edges.

In accordance with another aspect of the present invention, the side jamb members are rigidly affixed to the frame at the outer face thereof by means of intermittent welds extending longitudinally therealong on both sides thereof.

In accordance with still another aspect of the present invention, the intermittent welds on one side of each side jamb member are centered with the intermittent areas between welds on the other side of the side jamb member.

In accordance with still another aspect of the present invention, the frame is constructed from a steel plate and the side jamb members are also each constructed from steel plates.

In accordance with a still further aspect of the present invention, the difference between width $x$ and thickness $y$ is approximately 0.025 inch.

The principal object of the invention is the provision of an improved coke oven frame and jamb assembly which is rigid and which may be reshaped if necessary without removing the assembly from an associated coke oven.

Another object of the present invention is the provision of an improved coke oven frame and jamb assembly which is easy to manufacture.

Still another object of the present invention is the provision of an improved coke oven frame and jamb assembly which may be constructed from readily available and conventional materials.

Other objects of the invention will become apparent to those skilled in the art from a reading of the following specification and claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein:

FIG. 1 is a front elevational view of a coke oven frame and jamb assembly which incorporates the concepts of the subject invention;

FIG. 2 is a cross-sectional view taken along lines 2—2 of FIG. 1;

FIG. 3 is a cross-sectional view taken along lines 3—3 of FIG. 1;

FIG. 4 is a cross-sectional view taken along lines 4—3 of FIG. 1; and FIG. 5 is a cross-sectional view taken along lines 5—5 of FIG. 1.

DETAILED DESCRIPTION OF THE PREFERRED EMBODIMENT

Referring now to the drawings wherein the showings are for purposes of illustrating the preferred embodiment of the invention only and not for purposes of limiting same, the Figures show a coke oven front wall or frame A having a vertically elongated coke oven door opening B generally centrally located therein and a jamb construction C extending generally peripherally around the frame and interposed between the opening B and the outer peripheral edges of frame A itself.

More particularly and with reference to FIGS. 1 and 2, frame A is comprised of a frame plate 10 having opposed inner and outer faces 12, 14. The frame also includes a top edge 16, a bottom edge 18 and opposed side edges 20, 22. Coke oven door opening B is conventionally defined by a continuous peripheral wall generally designated 24.

In the preferred arrangement of the present invention, frame plate 10 is constructed from cold rolled mild steel plate, preferably steel having a carbon content not exceeding 0.20%, By way of further example, a plate thickness of 2.00 inches between inner and outer faces 12, 14 has been found to be particularly desirable and acceptable for most coke oven installations. However, this dimension could be increased or decreased as necessary for a particular installation or environment.

Jamb construction C is comprised of a top jamb member generally designated 30, a bottom jamb member generally designated 32 and a pair of opposed side jamb members generally designated 34, 36.

In the preferred embodiment of the invention herein under discussion, members 30, 32, 34 and 36 are all constructed from cold rolled mild steel plate having characteristics similar to frame plate 10 hereinabove previously discussed. Preferably, side members 34, 36 have a thickness $y$ of approximately 1.25 inches although, again, this dimension could be varied somewhat to accommodate a particular installtion of environment.

A jamb member receiving groove 40 is disposed adjacent each side edge 20, 22 and extends inwardly from outer face 14 toward inner face 12. These grooves are identical and are best shown in the overall frame and jamb assembly construction in FIG. 5. Grooves 40 extend continuously along side edges 20, 22 substantially between top edge 16 and bottom edge 18. Since both grooves 40 are identical the description made with reference to one of them is equally applicable to both. As best shown in FIGS. 3 and 4, groove 40 has a pair of opposed side walls 44, 46 and a bottom wall 48. The distance between side walls 44, 46, that is, the width of the grooves, comprises a dimension $x$. In accordance with the concepts of the present invention, width dimension $x$ is greater than thickness $y$ of side jamb members 34, 36 for specific reasons and purposes which will be discussed in detail hereinafter.

In the preferred arrangement of the present invention and as noted above, thickness $y$ of side jamb members 34, 36 is 1.25 inches. The preferred width $x$ is 1.275 inches so that the difference between width $x$ and thickness $y$ is 0.025 inch. This clearance may, however, be increased or decreased for certain circumstances and conditions without departing from the intent or scope of the broadest aspects of the present invention. With this dimensional arrangement, a small clearance area will be provided between the sides of side jamb members 34, 36 and side walls 44, 46 of the associated groove 40. This clearance is provided over the entire length of cooperation between grooves 40 and side jamb members 34, 36.

When constructing the frame and jamb assembly of the present invention, side jamb members 34, 36 are inserted into the associated grooves 40 in outer face 14 of frame plate 10 so that the innermost edge of the side jamb members contact groove bottom walls 48. In this installed position, side jamb members 34, 36 are welded to outer face 14 by means of intermittent welds generally designated 52, 54 in the Figures In FIG. 1, these welds are only shown in conjunction with side jamb member 36 and it should be appreciated that similar welds are employed in conjunction with side jamb member 34. Welds 52 are disposed on an intermittent weld basis longitudinally along member 36 on one side thereof and welds 54 are disposed longitudinally along the member on the other side thereof. As will be noted in FIG. 1, the welds on each side of the member are staggered over the entire length thereof. It is preferred that the welds on each side are spaced or centered with respect to the intermittent areas between the welds on the other side. In this regard and in the preferred embodiment here under discussion, the length of each weld 52, 54 is 4 inches with the intermittent areas between adjacent welds being each 1 inch. This arrangement may, of course, be modified slightly without departing from the intent or scope of the broadest aspects of the present invention although the specific spacing and location of the intermittent welds as noted above have been found to provide extremely satisfactory operational results.

Disposed along the outermost edge 60 of each of side jamb members 34, 36 are a pair of recessed areas generally designated 62 which closely receive locking bar hook retaining means generally designated 64. Conventionally, two such retaining means 64 are included in each side jamb member and the retaining means in one side jamb member are oppositely disposed from the retaining means in the other jamb member. Each retaining means includes a recessed area generally designated 66 having a plurality of mounting openings therein to mount a conventional door locking hook (not shown) therein by convenient mechanical fastening means. In view of the fact that such hooks and the mounting and locking of the door to the frame are deemed conventional and do not form a part of the present invention, they are not shown or described further herein. Retaining means 64 are conveniently welded to side jamb members 34, 36 once they have been properly positioned in recessed areas 62 in order to provide for a rigid construction.

As best shown in FIG. 2, top jamb member 30 is comprised of an angled portion 80 angled outwardly and upwardly from frame plate 10 with an outer portion 82 extending outwardly from the outermost end of angled portion 80. Portion 80, 82 are also constructed from mild steel plate similar to that from which frame plate 10 and side jamb members 34, 36 are constructed. These members extend between members 34, 36 and are also welded in the desired position. Extending downwardly from angled portion 80 on outer face 14 are a pair of parallel spaced apart support or gusset-like members 84 which add further rigidity to the overall structure. Bottom member 32 is comprised of an outer portion generally designated 86 and a gusset or support-like portion 88. As with portions 80, 82, portions 86, 88 are constructed from mild steel plates and are welded to the frame plate so as to extend between side jamb members 34, 36.

In use, frame A substantially comprises the entire front wall of the coke oven itself. The frame may be mounted to the oven superstructure by convenient means and is dimensioned so that the bottom of the frame will rest upon a face area provided therefor in the conventional oven brickwork. Moreover, and when the frame is in position, the face of the oven brickwork will also engage the top of the frame.

During oven operation and with a coke oven door closely received over coke oven door opening B in a conventional manner, frame A and the door are subjected to high temperatures, e.g., 2000° F and above. With such elevated temperatures, there is a tendency for the frame and door to be subjected to warpage which, as discussed above, can have extremely undesirable affects on the coking operation itself by air admission thereinto. Many of these problems have been successfully overcome in utilizing the frame and jamb structure of the subject invention as described in detail hereinabove.

First, the fact that the frame and jamb members are constructed from steel plates as opposed to cast iron as in the case of prior frames and jambs is advantageous in the event that some warpage does occur. With the present invention, it is possible to reshape the frame and jamb assembly while the structure remains mounted to the oven itself. With prior cast iron frame and jamb assemblies, it was necessary to remove the entire assemblies from operative association with the coke ovens before making any effort to reshape the assemblies. Normally, and even though removed from the ovens themselves, the prior cast iron frame and jamb assemblies were very difficult to reshape and quite often cracked during warpage and/or any reshaping efforts.

Second, the jamb members which extend outwardly from outer face 14 of frame plate 10 are such that they give additional rigidity to the overall frame structure. Moreover, because a clearance area is provided between the sides of at least side jamb members 34, 36 and side walls 44, 46 of grooves 40, heat pickup in frame plate 10 will not be entirely directly transmitted into side jamb members 34, 36. Further, the use of intermittent welds 52, 54 is such that the spacing between the individual welds provides a path for heat escape from this clearance area so that any heat transfer from frame plate 10 is side jamb members 34, 36 may be further reduced. Also, because of the symmetrical staggering of welds 52, 54, there will be no tendency for the side jamb members to warp in an uneven manner.

The present invention provides for a definite reaction to the stresses in frame plate 10 and side jamb members 34, 36 in a manner such that one of these members will not react to the pressures of the other when the frame and jamb assembly is subjected to elevated temperatures. As a result, the resultant structure is more rigid than prior structures or assemblies utilized for the same purpose.

The subject frame and jamb assembly may be readily adapted to fit various coke oven sizes and styles thus making the assembly readily adaptable to use with existing ovens on a replacement basis. Moreover, the cold rolled mild steel plates are readily obtainable and are not special order items as were the prior art cast iron frame and jamb assemblies. The subject invention has found substantial acceptance in actual commercial applications and installations.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. In a coke oven of the type having an elongated vertical opening in the front wall thereof with a frame received thereover which has a coke oven opening in the central portion thereof adapted to operably receive a coke oven door in a covering relationship therewith and wherein said frame has generally flat inner and outer faces, a top edge, a bottom edge and opposed elongated side edges with a jamb disposed about at least a portion of said outer face adjacent the outer peripheral edges thereof, the improvement comprising:

said frame outer face including a groove extending longitudinally therealong adjacent each side edge, said grooves having a width $x$ and a groove bottom wall; an elongated side jamb member received in each of said grooves against said groove bottom walls with said side jamb members having a thickness $y$ which is less than width $x$ such that a clearance area is provided between the portions of said side jamb members received in said grooves and the side walls of said grooves with said side jamb members extending outwardly of said frame outer face and being rigidly affixed thereto; and, said frame and at least said side jamb members being constructed from mild steel plate.

2. The improvement as defined in claim 1 wherein said side jamb members are rigidly affixed to said frame at said outer face by means of intermittent welds extending longitudinally therealong on both sides thereof.

3. The improvement as defined in claim 2 wherein the intermittent welds on one side of each side jamb member are centered relative to the intermittent areas between the intermittent welds on the other side of the side jamb member.

4. The improvement as defined in claim 3 wherein each of said intermittent welds is 4 inches long and the intermittent areas between adjacent welds are 1 inch long.

5. The improvement as defined in claim 1 wherein said clearance area is approximately 0.025 inch.

6. The improvement as defined in claim 1 wherein said frame is constructed from a steel plate having a thickness of approximately 2 inches and said side jamb members are each constructed from a mild steel plate having a thickness of approximately 1.25 inches.

7. The improvement as defined in claim 6 wherein the width of said grooves is approximately 1.275 inches.

8. The improvement as defined in claim 1 further including top and bottom jamb members extending outwardly from said frame outer face between said side jamb members adjacent said frame top and bottom edges.

9. The improvement as defined in claim 8 wherein said top and bottom jamb members are constructed from mild steel plate and rigidly affixed to said frame outer face.

* * * * *